US005937248A

United States Patent [19]

Liu et al.

[11] Patent Number: 5,937,248

[45] Date of Patent: Aug. 10, 1999

[54] CONTACT ELECTROSTATIC PRINTING IMAGE FORMING METHOD AND APPARATUS USING IMAGE AREA CENTERED PATCH OF TONERPATCHES OF TONER

[75] Inventors: Chu-Heng Liu, Penfield; Weizhong Zhao, Webster, both of N.Y.

[73] Assignee: Xerox Corporation, Stamford, Conn.

[21] Appl. No.: 09/197,785

[22] Filed: Nov. 23, 1998

[51] Int. Cl.[6] ..... G03G 15/10

[52] U.S. Cl. ..... 399/237; 399/296

[58] Field of Search ..... 399/169, 237, 399/238, 239, 240, 296

[56] References Cited

U.S. PATENT DOCUMENTS

| | | | |
|---|---|---|---|
| 4,504,138 | 3/1985 | Kuehnle et al. | 355/10 |
| 5,387,760 | 2/1995 | Miyazawa et al. | 118/661 |
| 5,436,706 | 7/1995 | Landa et al. | 355/256 |
| 5,563,688 | 10/1996 | Bergen et al. | 399/169 |
| 5,619,313 | 4/1997 | Domoto et al. | 399/233 |
| 5,826,147 | 10/1998 | Liu et al. | 399/237 |

*Primary Examiner*—Arthur T. Grimley
*Assistant Examiner*—William A. Noe
*Attorney, Agent, or Firm*—Tallam I. Nguti

[57] ABSTRACT

A printing machine and method for efficiently forming toner images such that a quantity of unused toner applied to a photoreceptor of the machine is significantly diminished are provided. The printing machine and method include a movable photoreceptor having a photoconductive surface for supporting electrostatic charge; a first charging device for selectively charging only scattered portions of the surface of the photoreceptor; a liquid developer material supply and application apparatus for applying a coat of charged toner solids having a single polarity onto each charged selected scattered portion, thereby forming an image area patch of toner; an exposure device for image-wise exposing each charged selected scattered portion to form a first latent image therein; and a contact electrostatic printing (CEP) assembly including a conductive (CEP) roll and a bias source coupled thereto, for applying compressive and tensile forces to the image area centered patches of toner moving through an image processing nip formed by the photoconductive surface of the photoreceptor and the conductive CEP roll, wherein the bias source cooperates with a charge pattern of the image area centered patches of toner to generate image-wise electric fields within the image processing nip, and the image-wise electric fields together with the compressive and tensile forces, enable easy separation of background area toner solids from image area toner solids of the image area centered patches of toner, and onto the CEP roll; thereby resulting in an efficiently produced, quality toner image with significantly reduced non-development marking material generated and requiring removal.

9 Claims, 5 Drawing Sheets

FIG. 2
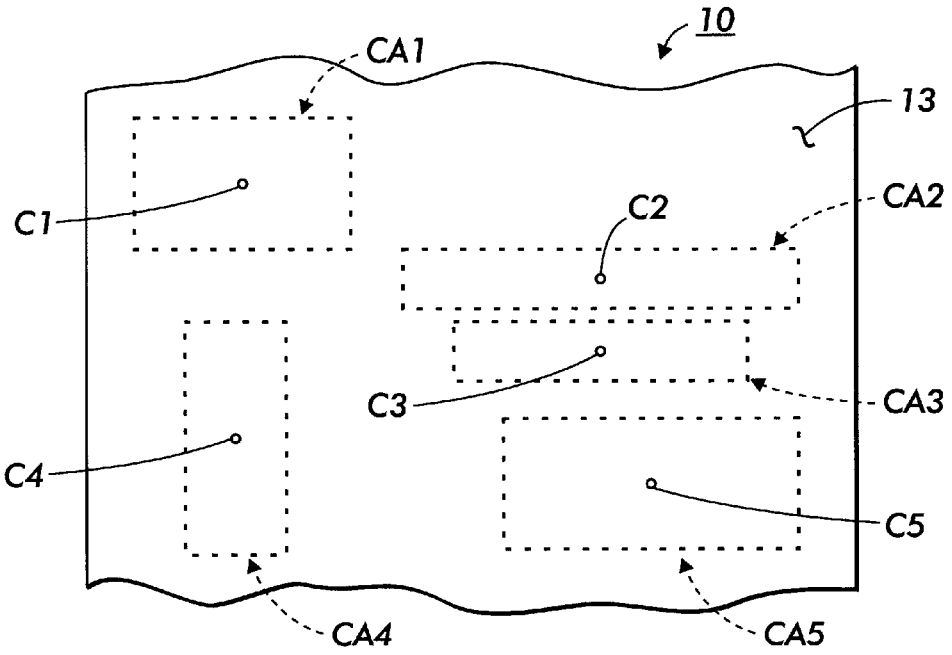
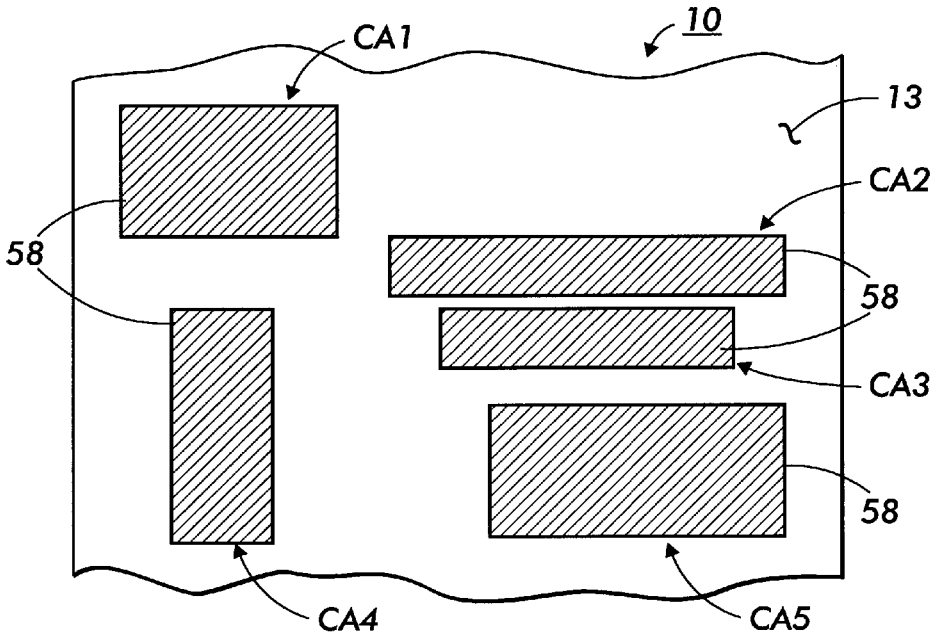
FIG. 3

CONTACT ELECTROSTATIC PRINTING IMAGE FORMING METHOD AND APPARATUS USING IMAGE AREA CENTERED PATCH OF TONERPATCHES OF TONER

RELATED CASES

This application is related to U.S. application Ser. No. 09/197,793 (Applicants' Docket No. D/97345) entitled "IMAGE FORMING REVERSE CHARGE PRINTING METHOD AND APPARATUS USING IMAGE AREA CENTERED PATCHES OF TONER" filed on even date herewith; and U.S. application Ser. No. 09/197,753 (Applicants' Docket No. D/97345Q2) entitled "AIR BREAKDOWN CHARGE AND DEVELOPMENT IMAGE FORMING METHOD AND APPARATUS USING IMAGE AREA CENTERED PATCHES OF TONER" filed on even date herewith; and each having at least one common inventor.

BACKGROUND OF THE INVENTION

This invention relates generally to electrostatographic image forming methods, and more particularly, concerns a contact electrostatic printing (CEP) toner image forming apparatus and method for forming and developing an electrostatic latent image from an image area centered patch of developing or toner material coated on selectively charged portions of a photoreceptor. The method and apparatus advantageously diminish the quantity of non-development toner being handled by the machine during latent image development, and thus increases the efficiency of the machine as well as the quality of toner images formed.

Generally, processes for electrostatographic copying and printing are initiated by uniformly charging and selectively discharging a charge receptive photoreceptor in accordance with an original input document or an imaging signal, generating an electrostatic latent image on the photoreceptor. This latent image is subsequently developed into a visible image by a process in which charged developing material or toner solids are deposited onto the surface of the latent photoreceptor, wherein charged toner solids or particles in the developing material adhere to image areas of the latent image.

The developing material typically comprises carrier granules having marking or toner particles adhering triboelectrically thereto, wherein the toner particles are electrostatically attracted from the carrier granules to the latent image areas to create a powder toner image on the photoreceptor. Alternatively, the developing material may comprise a liquid developing material comprising a carrier liquid having pigmented marking particles (or so-called toner solids) and charge director materials dispersed and/or dissolved therein (so-called liquid toner), wherein the liquid developing material is applied to the latent image bearing photoreceptor with the marking particles being attracted to the image areas of the latent image to form a developed liquid image.

Regardless of the type of developing material employed, the toner or marking particles of the developing material are uniformly charged and electrostatically attracted to the latent image to form a visible developed image corresponding to the latent image on the photoreceptor. The developed image is subsequently transferred, either directly or indirectly, from the photoreceptor to a copy substrate, such as paper or the like, to produce a "hard copy" output document. In a final step, the photoreceptor is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface. It will be understood that the instant invention applies to all various types of electrostatic printing systems and is not intended to be limited by the manner in which the image is formed on the photoreceptor or the nature of the photoreceptor itself.

As described hereinabove, the typical electrostatographic printing process includes uniformly charging the entire surface of the photoreceptor, image-wise exposing the entire surface, and physically transporting developing material including charged marking or toner particles into contact with the photoreceptor so as to selectively develop the latent image areas thereon in an image-wise configuration. Development of the latent image is usually accomplished by electrostatic attraction of charged toner or marking particles to the image areas of the latent image.

The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

Numerous and various alternative methods of developing a latent image have been described in the art of electrophotographic printing and copying. Of particular interest with respect to the present invention is the concept of forming on a surface, a thin layer of liquid developing material having a high concentration of charged marking particles, with the layer being acted upon by image-wise forces, and being separated into image and background portions. For the purposes of the present description, the concept of latent image development via direct surface-to-surface transfer of a toner layer via image-wise forces will be identified generally as Contact Electrostatic Printing (CEP). Air Breakdown Charge and Development (ABCD), is one variant of CEP, wherein a thin layer of liquid developer material is recharged using an air breakdown charging device, into opposite charge polarities in the image and background areas, which are thereafter separated. Because of the relatively large fraction of toner mass traditionally left in the background areas, cleaning and reuse of such toner from the background areas ordinarily can detrimentally affect the efficiency of the overall printing system.

The following sample references may be relevant as background art for the present invention. For example, U.S. Pat. No. 4,504,138 discloses a method of forming a latent electrostatic image on a uniformly charged surface, and developing the latent electrostatic image by applying a thin viscous layer of electrically charged toner particles to the electrostatic latent image. The apparatus includes an applicator roller mounted for rotation in a container for toner suspension, an electrode arranged adjacent the circumferential surface of the roller to define an electrodeposition chamber therebetween, and electrical connections between the roller, the electrode and a voltage source to enable electrolytic separation of toner particles in the chamber, thus forming a thin highly viscous layer of concentrated toner particles on the roller.

U.S. Pat. No. 5,387,760 discloses a wet development apparatus for use in a recording machine to develop a toner image corresponding to an electrostatic latent image on a uniformly charged electrostatic latent image carrying member or carrier. The apparatus includes a development roller disposed in contact with or near the electrostatic latent image carrier and an application head for applying a uniform layer of wet developer material to the roller.

U.S. Pat. No. 5,436,706 discloses an imaging apparatus including a first member having a first uniformly charged surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selectively transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, uniformly applying a layer of charge having a second electrical potential onto the charge bearing surface, and image-wise dissipating charge from portions on the charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving photoreceptor to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

In each of the sample types of references, the photoreceptor is typically charged uniformly, meaning that the entire surface of the photoreceptor is charged. Subsequently, non-image or background areas, for example, are then discharged in order to prevent them from being developed with non-image developing toner, along with image areas. In each of these references, image quality and inefficiency of the method and apparatus are therefore concerns. Image quality for example is a concern because it may vary significantly due to numerous conditions affecting latent image formation as well as latent image development. In particular, image development can be affected by charge levels, both in the latent image, as well as in the developing material. For example, when the charge on dry toner particles becomes significantly depleted, binding forces with the carrier also become depleted, causing an undesirable increase in image development, which, in turn, causes the development of the latent image to spread beyond the area defined thereby.

Inefficiency in an image forming method and apparatus is impacted significantly, for example, by the quantity or volume of non-development or unused charged toner material that is applied to the photoreceptor and moved through the development nip. Such non-development charged toner can undesirably affect charge levels of cooperating elements, and of course has to be removed or cleaned subsequently from the photoreceptor in order to ready the photoreceptor for recharging and reuse. Such cleaning or removal efforts involve inefficiencies in themselves, and it is of course time consuming and costly to recycle or dispose of such non-development or unused charged toner after it has been applied to the photoreceptor, and moved through the development nip.

SUMMARY OF THE INVENTION

The present invention specifically contemplates a novel electrostatographic image forming method and apparatus wherein to start, only selective scattered portions of a surface of a photoreceptor (and not the entire surface) are charged. Each selected portion of the scattered portions is preferably centered relative to, and has an area that slightly exceeds an image area or area to be imaged. Each charged selected portion is then coated with a layer of marking material or toner thereby forming an "image area centered patch of toner" (IACP). The image area centered patch of toner is then image-wise exposed to form a first latent image therein. The exposed image area centered patch of toner is subsequently developed into a toner image using a contact electrostatic printing (CEP) toner image forming step, thereby resulting in an efficiently produced, quality toner image with significantly reduced nondevelopment marking material generated and requiring removal.

In accordance with one aspect of the present invention, there is provided a printing machine and method for efficiently forming toner images such that a quantity of unused toner applied to a photoreceptor of the machine is significantly diminished are provided. The printing machine and method include a movable photoreceptor having a photoconductive surface for supporting electrostatic charge; a first charging device for selectively charging only scattered portions of the surface of the photoreceptor; a liquid developer material supply and application apparatus for applying a coat of charged toner solids having a single polarity onto each charged selected scattered portion, thereby forming an image area patch of toner; an exposure device for image-wise exposing each charged selected scattered portion to form a first latent image therein; and a contact electrostatic printing (CEP) assembly including a conductive (CEP) roll and a bias source coupled thereto, for applying compressive and tensile forces to the image area centered patches of toner moving through an image processing nip formed by the photoconductive surface of the photoreceptor and the conductive CEP roll, wherein the bias source cooperates with a charge pattern of the image area centered patches of toner to generate image-wise electric fields within the image processing nip, and the image-wise electric fields together with the compressive and tensile forces, enable easy separation of background area toner solids from image area toner solids of the image area centered patches of toner, and onto the CEP roll; thereby resulting in an efficiently produced, quality toner image with significantly reduced non-development marking material generated and requiring removal.

BRIEF DESCRIPTION OF THE DRAWINGS

These and other aspects of the present invention will become apparent from the following description in conjunction with the accompanying drawings in which:

FIG. 2 is an illustration of scattered image area centered portions of the surface of the photoreceptor of the machine of FIG. 1, charged by a first charging device in accordance with the present invention;

FIG. 3 is an illustration of the charged scattered image area centered portions of the surface of the photoreceptor of the machine of FIG. 1, showing toner coated thereon to form Image Area Centered Patches of toner in accordance with the present invention;

DETAILED DESCRIPTION OF THE INVENTION

While the present invention will be described in terms of an illustrative embodiment, it will be understood that the invention is adaptable to a variety of copying and printing applications, and is not necessarily limited to the particular embodiment shown and described herein. On the contrary, the following description is intended to cover all alternatives, modifications, and equivalents, as may be included within the spirit and scope of the invention as defined by the appended claims.

Figure 1:
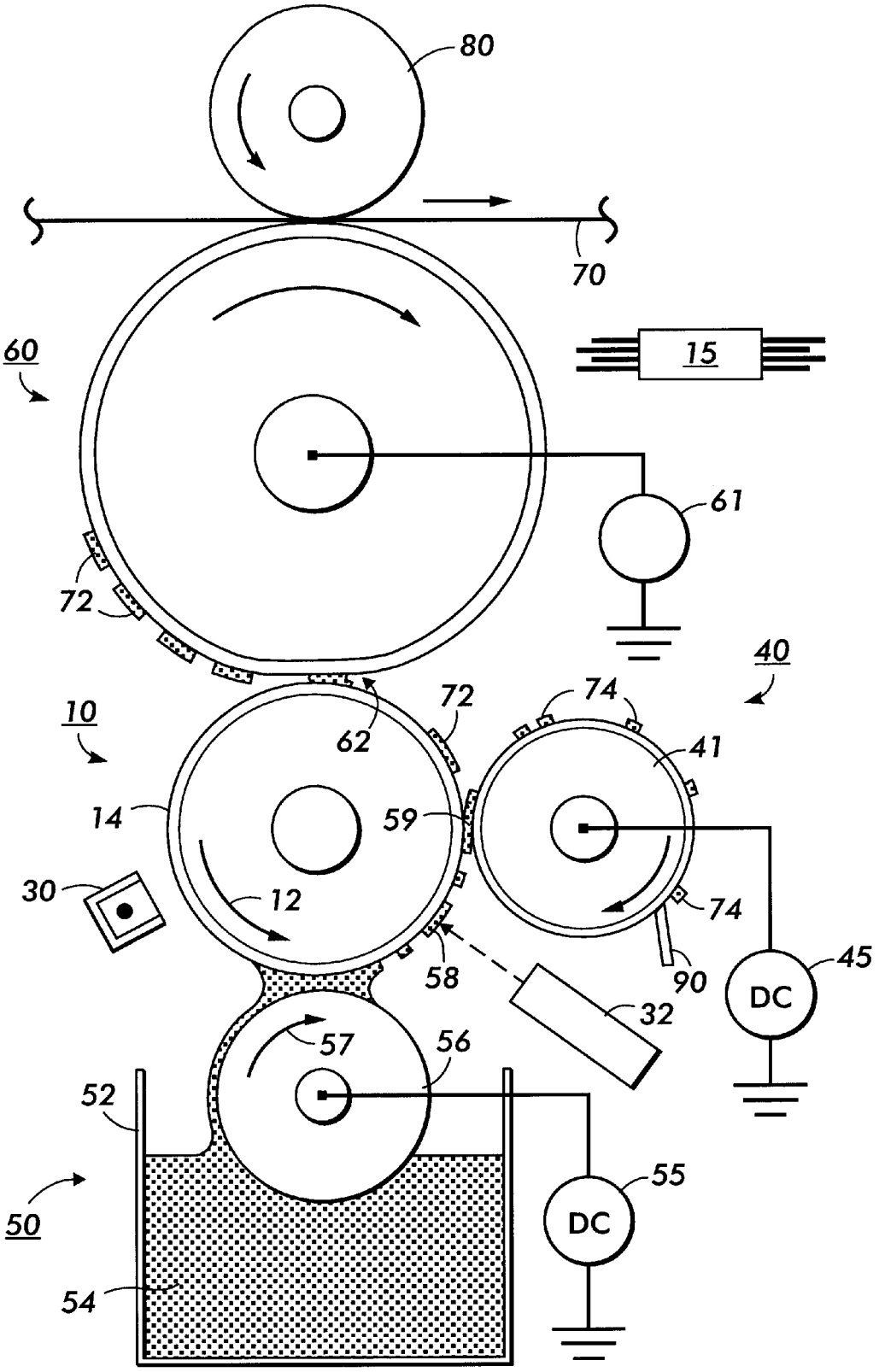
FIG. 1 is a simple schematic illustration depicting a liquid printing machine such as a liquid immersion development (LID) machine, for forming toner images using image area centered patches of toner in accordance with the present invention.

Referring now to FIGS. 1 and 2, a liquid printing machine 8 and parts thereof, capable of forming toner images in accordance with the present invention are illustrated. As shown, the machine includes an assemblage of operatively associated image forming and control elements, including an photoreceptor 10, and an electronic control subsystem or controller 15 for controlling the operations of various elements of the machine 8.

Photoreceptor 10 includes an imaging surface 13 of any type capable of supporting electrostatic charges and an electrostatic latent image formed thereon. Although the following description will be directed by example to a system and process incorporating a photoconductive photoreceptor, it will be understood that the present invention contemplates the use of various alternative embodiments for a photoreceptor as are well known in the art of electrostatographic printing, including, for example, but not limited to, non-photosensitive photoreceptors such as a dielectric charge retaining member of the type used in ionographic printing machines, or electroded substructures capable of generating charged latent images.

Photoreceptor 10 is rotated, as indicated by arrow 11, so as to transport the surface 13 thereof in a process direction for implementing a series of image forming steps in accordance with the method of the present invention. Initially, the photoconductive surface 13 is moved through a charging station, which is shown including a corona generating first charging device 30. Importantly, the first charging device 30 is connected to the controller 15 for further enabling it to apply electrostatic charge to selected scattered portions shown in FIG. 2 as CA1, CA2, CA3, CA4, and CA5, of the surface 13 of the photoreceptor 10. FIG. 2 is an illustration of scattered image area centered portions, of the surface 13 of the photoreceptor 10, that have been charged by the first charging device 30 in accordance with the present invention. The corona generating first charging device 30 preferably is capable of charging such each selective portion of the photoconductive surface to a relatively high potential.

Importantly too, each such charged selected scattered portion CA1, CA2, CA3, CA4, and CA5 is centered on, or has a common center C1, C2, C3, C4 and C5, respectively with a corresponding area of the surface 13, which (as pre-determined by the controller 15), is to be imaged in subsequent steps. Such pre-determination can be based on information or image data about a finished toner image sheet or page for which a particular section or image frame of the surface 13 is being processed.

Referring now to FIGS. 1 and 3, the surface 13 of the photoreceptor 10 with the selected scattered portions CA1, CA2, CA3, CA4, and CA5 thereon, is then advanced to a toner solids coating station that includes a toner supply and coating apparatus 50. In accordance with an aspect of the present invention, the apparatus 50 supplies and applies a thin coat of charged marking or toner particles to charged scattered selective portions CA1, CA2, CA3, CA4, and CA5, thus producing a scattered or non-uniform pattern of image area centered patches 58 of toner solids (FIG. 3) on the surface 13 of the photoreceptor 10.

As further shown in FIG. 1, the toner supply and applicator apparatus 50 includes a housing 52 that is adapted to accommodate a supply of toner particles 54 and any additional carrier material, if necessary. The apparatus 50 also includes an applicator roller 56 which is rotated in a direction as indicated by arrow 57 to transport toner from housing 52 into contact with the surface of the photoreceptor 10, onto which it forms a toner solids coat onto each charged scattered selective portions CA1, CA2, CA3 CA4, and CA5, thus producing a scattered or non-uniform pattern of image area centered patches of toner "cake" or toner solids 58 (FIG. 3) on the surface 13 of the photoreceptor 10.

The toner "cake" or toner solids coat 58 described above can be created in various ways. For example, depending on the materials utilized in the printing process, as well as other process parameters such as process speed and the like, a coating of toner particles having sufficient thickness, preferably on the order of between 2 and 15 microns and more preferably between 3 and 8 microns, may be formed on the surface of the photoreceptor 10 by employing electrical biasing to assist in actively moving the charged toner particles or solids from the applicator 56 onto the latent image portions of the surface of the photoreceptor 10. Therefore, the applicator roller 56 is preferably coupled to an electrical biasing source 55 for implementing a so-called forward biasing scheme, wherein the toner applicator 56 is provided with an electrical bias of magnitude sufficient to create electrical fields extending from the toner applicator roll 56 to the selected latent image portions on the surface of the photoreceptor 10, thus creating the toner "cake" or toner solids coat 58 described above.

Figure 4:
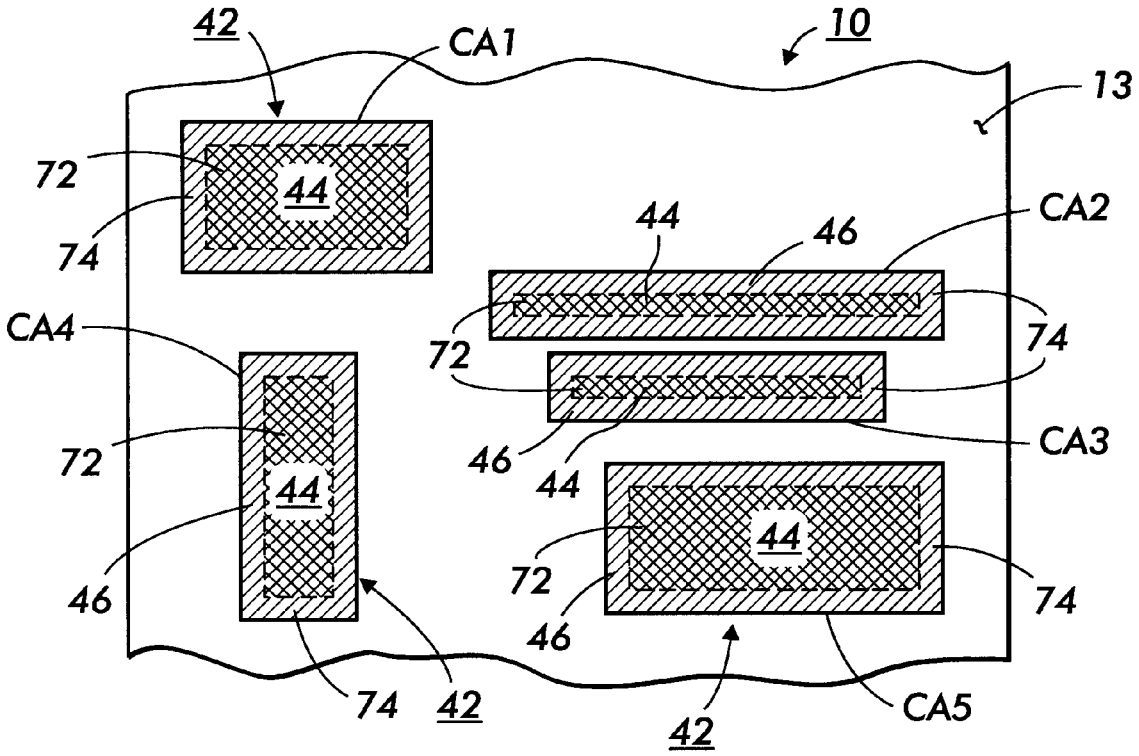
FIG. 4 is an illustration of the charged and coated scattered image area centered portions of the surface of the photoreceptor of the machine of FIG. 1, image-wise exposed in accordance with the present invention.

Referring now to FIGS. 1 and 4, the machine includes an exposure device 32 that is connected to the controller 15 for image-wise exposing each charged and coated scattered selective portion CA1, CA2, CA3, CA4, and CA5 to form a latent image 42 having image areas 44 and background areas 46. The surface 13 of the photoreceptor 10 with the charged scattered selective portion CA1, CA2, CA3, CA4, and CA5 thereon is then advanced to the exposure device 32 which projects a light image onto each such portion corresponding to an input image to be reproduced thereon. In the case of an imaging system having a photosensitive photoreceptor, as currently described, the light image projected onto the charged and toner coated scattered selective portions CA1, CA2, CA3, CA4, and CA5 of the surface 13, selectively dissipates charges in sections thereon for recording an electrostatic latent image 42 on each such portion. Each such first electrostatic latent image 42 thus comprises an image area 44 defined by a first charge voltage, and a background area 46 defined by a second charge voltage.

Figure 5:
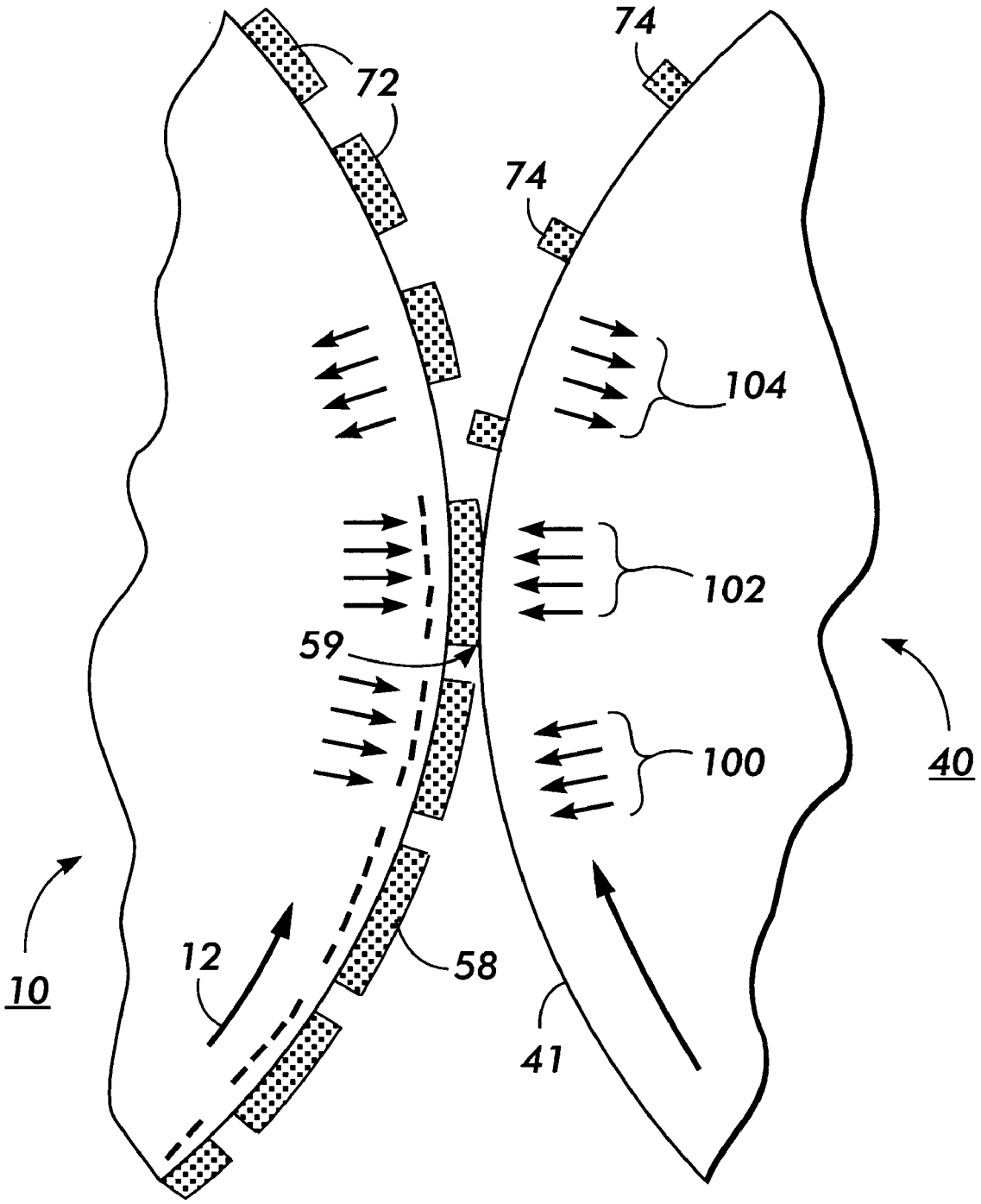
FIG. 5 is an exploded view illustrating image-wise field acting upon the patches of toner of FIG. 4 and the separation of the toner solids in the image areas from the toner solids in the background areas.

Referring now to FIGS. 1 and 5, after the "cakes" or image area centered patches of toner 58 and the latent image are formed as above, they are moved passed a contact electrostatic printing (CEP) biased roll 41 of the present invention for image/background separation and development. CEP (Contact Electrostatic Printing) method and apparatus used as a primary process for forming toner images from a uniform toner layer, are disclosed for example in U.S. application Ser. No. 08/963,360, filed Nov. 3, 1997 in the name of the current inventors, (relevant parts of which are incorporated herein by reference). As disclosed therein, CEP employs uniform photoreceptor surface charging; latent image formation; uniform, non-image toner layer coating covering an entire second surface; and a biasing source for providing a suitable potential to the second surface and applying compressive and tensile forces to the toner layer. Such biasing and application of compressive and tensile forces cooperate with the charge pattern under the uniform toner layer to effectively enable the separation of toner solids in the image areas from those in the background areas, depending on the bias on the CEP roll. In the present invention, the image area centered patch of toner or "cake" 58 is used in place of the uniform entire surface coating layer of liquid toner. In addition, the high concentration thin toner layer formed on the latent image bearer (the photoreceptor) enables high speed and high quality development.

Accordingly therefore, after the image area centered patches of toner or "cakes" 58 are formed as above on the surface of the photoreceptor 10, they are brought into pressure contact with a Contact Electrostatic Printing (CEP) assembly 40 including a biased roll 41. Such contact is achieved by the photoreceptor 10 transporting the toner "cakes" 58 through a process nip 59 which the photoreceptor 10 forms with the CEP biased roll 41. As shown, the contact electrostatic CEP assembly, includes a bias source 45 coupled to a conductive and conformable roll 41 that forms an image processing nip 59 with the photoconductive surface of the photoreceptor 10.

Within the image processing nip 59 the bias 45 source cooperates with the latent image pattern of each image area centered patch of toner to generate image-wise electric fields within the nip. It is preferable that either the CEP biased roll 41 or the photoreceptor 10 be a conformable member (as shown in FIG. 5), in order to permit the surface of one member to conform to the opposing surface in the nip region. When the surface of the CEP biased roll 41 is engaged with that of the photoreceptor 10 within the nip 59, each toner "cake" 58 sandwiched in the nip is substantially uniformly distributed within the nip such that toner solids motion and/or liquid flow is negligible. There is therefore little or no distortion present or induced in such toner "cake" 58.

As further illustrated in FIG. 1, the electrical biasing source 45 is coupled to the roll 41 for applying an electrical bias thereto in order to generate electrostatic fields between the surface of CEP roll 41 and each image area centered patch of toner or "cake" 58 (image area toner solids 72 and background area toner solids thereof 74) on the photoreceptor 10. It is preferable that the CEP biased roll 41 is conductive or that it has only a very thin dielectric coating. In order to generate electrostatic forces that enable image areas from background areas separation, the electric fields in the image and background areas must be opposite in direction. Thus, the potential on the separation roll is preferably intermediate of the potentials of the image and background areas. As illustrated in FIG. 1, the roll 41 is biased by the source 45 and preferably at a voltage that is intermediate of the voltages of the image areas 44 and background areas 46 of the underlying latent image 42 of each image area centered patch of toner or "cake" 58. As further illustrated in FIG. 5, these generated electrostatic fields include field lines moving towards opposite directions depending on whether they are over image areas 44 (toner solids 72) or over background areas 46 (toner solids 74) of each image area centered patch of toner or "cake" 58. Thus the field lines are either moving towards the surface of the photoreceptor 10, or towards the surface of CEP biased roll 41. Importantly, this difference in direction of the field lines advantageously enables easy simultaneous separation of toner solids 72 in the image areas from toner solids 74 in the background areas of each toner "cake" 58 as it exits the nip 59.

Importantly too, within the nip 59, the photoreceptor 10 and the CEP roll 41 should be moving in the same direction and at the same speed so as to enable tensile force separation in accordance with the present invention, and so as to minimize image smear and distortion.

As shown, the CEP roll 41 is biased by the source 45 so as to cause it to repel toner solids 72 in image areas of each "cake" 58, thereby resulting in a final toner image made up of the toner solids 72 on the surface of the photoreceptor 10, while leaving background image byproduct or toner solids 74 of the background areas, on the surface of the CEP biased roll 41. Alternatively and given an appropriate patch of toner applications onto the photoreceptor, for example, toner layer covers the entire surface of the photoreceptor, the CEP biased roll 41 may be provided with an electrical bias that is appropriate for attracting toner solids 72 in image areas, while repelling those, 74 in the background areas toward photoreceptor 10.

Once the advantageously reduced quantity of unwanted background toner solids 74 are separated onto the surface of CEP roll 41, the image area toner solids comprising a final efficiently formed toner image, are advanced to an intermediate transfer member (ITM) shown as a roll 60. As shown, ITM 60 is provided in the form of a biased roll member forming an image transfer nip 62 with the surface of the photoreceptor 10 and preferably contacting the final toner image residing on photoreceptor 10. An electrical biasing source 61 is coupled to the ITM 60 to bias the ITM 60 so as to attract the toner image area toner solids.

After the final toner image is transferred onto the ITM 60, it is then transferred to a copy substrate 70 via any means known in the art, which may include an electrostatic transfer apparatus including a corona generating device of the type previously described or a biased transfer roll. Alternatively, a pressure transfer system may be employed which may include a heating application device 80 for assisting in the pressure transfer and fixing of the developed image on the output copy substrate 70. In yet another alternative, image transfer can be accomplished via surface energy differentials wherein the surface energy between the image and the member supporting the image prior to transfer is lower than the surface energy between the image and the substrate 70, inducing transfer thereto.

In a preferred embodiment, as shown in FIG. 1, the image is transferred to a copy substrate via a heated pressure roll, whereby pressure and heat are simultaneously applied by a heated roll 80 to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, etc.), or other known fixation process which may include the introduction of a chemical fixing agent.

Figure 6:
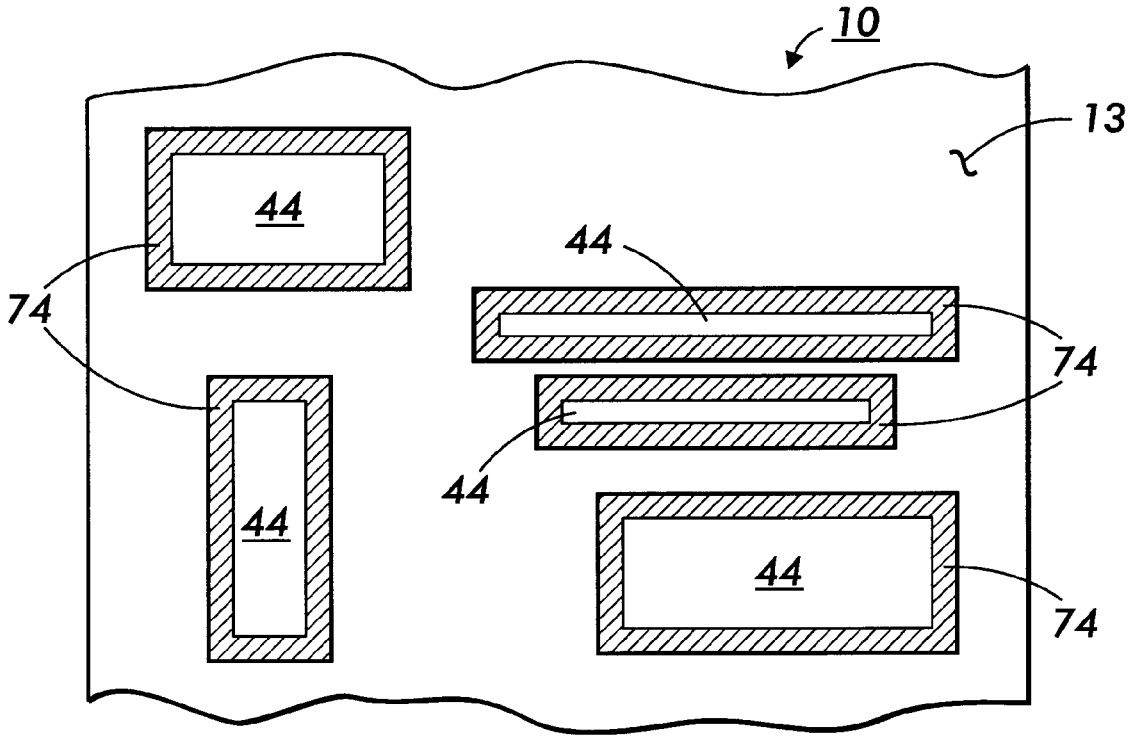
FIG. 6 is an illustration of significantly reduced or diminished toner residue left of each scattered image area centered patch of toner on the surface of the image separator of the machine of FIG. 1, following image formation in accordance with the present invention.

As can be seen, there has been provided an efficient and high quality image forming method and apparatus in which the quantity or volume of non-development or unused charged toner solids that are applied to the photoreceptor and moved through the development nip is significantly reduced or diminished. FIG. 6 is an illustration of significantly reduced or diminished non-development or waste toner left of each scattered image area centered patch of toner 58 on the surface of the photoreceptor 10 following image formation and transfer in accordance with the present invention. Accordingly, undesirable effects of such non-development charged toner on other charge sensitive machine elements are minimized, and subsequent removal or cleaning of such toner solids from the photoreceptor 10 in order to ready the photoreceptor for recharging and reuse, is also made easy and less costly.

In a final step in the process, the background toner solids or byproduct on the CEP roll 41 is removed from the surface thereof by a cleaning device 90 in order to clean the surface in preparation for a subsequent imaging cycle. FIG. 1 illustrates a simple blade cleaning apparatus for scraping the imaging member surface as is well known in the art. Alternative embodiments may include a brush or roller member for removing toner from the surface on which it resides.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. An efficient electrostatographic image forming method wherein a quantity of non-development toner being applied to a photoreceptor is significantly diminished, the method comprising the steps of:

(a) charging only selected scattered portions of a photoconductive surface of a photoreceptor;

(b) applying a coat of charged toner solids having a single polarity onto each selected scattered portion to form an image area patch of toner thereon;

(c) image-wise exposing each selected scattered portion to form a latent image therein; and (d) applying compressive and tensile forces to each image area patch of toner moving through an image processing nip formed by the photoconductive surface of the photoreceptor and a conductive contact electrostatic printing (CEP) roll biased by a bias source coupled thereto, wherein the bias source cooperates with charge patterns in each image area patch of toner to generate image-wise electric fields within the image processing nip, and the image-wise electric fields together with the compressive and tensile forces enable easy separation of background area toner solids from image area toner solids in each image area patch of toner, the background area toner solids being transferred from the photoconductive surface of the photoreceptor onto the CEP roll; thereby resulting in an efficiently produced, quality toner image with significantly reduced non-development marking material generated and requiring removal.

2. The method of claim 1, wherein said charging step comprises charging only selected scattered portions, each of which is centered about an area of the photoconductive surface to be imaged.

3. The method of claim 1, wherein said charging step comprises charging only selected scattered portions, each of which is centered about an area of the photoconductive surface to be imaged and has an area slightly exceeding that of the area of the photoconductive surface to be imaged.

4. A printing machine for efficiently forming toner images such that a quantity of unused toner applied to a photoreceptor of the machine is significantly diminished, the printing machine comprising:

(a) a movable photoreceptor having a photoconductive surface for supporting electrostatic charge and a toner image;

(b) a charging device for charging only selected scattered portions of said photoconductive surface of said photoreceptor;

(c) a liquid developer material supply and application apparatus for applying a coat of charged toner solids having a single polarity onto each selected scattered portion to form an image area patch of toner thereon;

(d) an exposure device for image-wise exposing each selected scattered portion to form a latent image therein; and (e) a contact electrostatic printing (CEP) assembly including a conductive roll and a bias source coupled thereto, for applying compressive and tensile forces to each image area patch of toner moving through an image processing nip formed by said photoconductive surface of said photoreceptor and said conductive CEP roll, said bias source cooperating with charge patterns in each image area patch of toner to generate image-wise electric fields within said image processing nip, said image-wise electric fields together with said compressive and tensile forces enabling easy separation of background area toner solids from image area toner solids in each image area patch of toner, the background area toner solids being transferred from the photoconductive surface of the photoreceptor onto said conductive CEP roll; thereby resulting in an efficiently produced, quality toner image with significantly reduced non-development marking material generated and requiring removal.

5. The printing machine of claim 4, wherein each selected scattered portion is centered relative to an area of the photoconductive surface to be imaged.

6. The printing machine of claim 4, wherein each selected scattered portion is centered about an area of the photoconductive surface to be imaged, and has an area slightly exceeding that of the area of the photoconductive surface to be imaged.

7. The printing machine of claim 4, wherein said conductive CEP roll conforms to the photoconductive surface of the photoreceptor to apply force to each image area patch of toner moving through the image processing nip.

8. The printing machine of claim 4, wherein within said image processing nip, said conductive CEP roll moves in a same direction as said photoreceptor.

9. The printing machine of claim 4, wherein within said image processing nip, said conductive CEP roll moves at a same speed as said photoreceptor.

* * * * *